US010368592B2

(12) United States Patent
Roh

(10) Patent No.: US 10,368,592 B2
(45) Date of Patent: Aug. 6, 2019

(54) INTELLIGENT GARMENT ADJUSTING HEATING TEMPERATURE THEREOF BY SENSING THE SIZE OF GARMENT APERTURE CHANGED ACCORDING TO USER CONTROL

(71) Applicant: Sangmyung University Seoul Industry-Academy Cooperation Foundation, Seoul (KR)

(72) Inventor: Jung-Sim Roh, Seoul (KR)

(73) Assignee: SANGMYUNG UNIVERSITY SEOUL INDUSTRY-ACADEMY COOPERATION FOUNDATION, Seoul (KR)

( * ) Notice: Subject to any disclaimer, the term of this patent is extended or adjusted under 35 U.S.C. 154(b) by 283 days.

(21) Appl. No.: 15/358,825

(22) Filed: Nov. 22, 2016

(65) Prior Publication Data

US 2017/0340028 A1 Nov. 30, 2017

(30) Foreign Application Priority Data

May 27, 2016 (KR) ..... 10-2016-0065816

(51) Int. Cl.

| | |
|---|---|
| ***A41D 13/005*** | (2006.01) |
| ***A41D 1/02*** | (2006.01) |
| ***H05B 3/34*** | (2006.01) |
| ***A41B 1/08*** | (2006.01) |
| ***A41D 1/00*** | (2018.01) |

(Continued)

(52) U.S. Cl.

CPC ..... *A41D 13/0051* (2013.01); *A41B 1/08* (2013.01); *A41D 1/002* (2013.01); *A41D 1/005* (2013.01); *A41D 1/04* (2013.01); *A41D 1/06* (2013.01); *A41D 3/00* (2013.01); *H05B 3/342* (2013.01); *H05B 3/347* (2013.01);

(Continued)

(58) Field of Classification Search

None

See application file for complete search history.

(56) References Cited

U.S. PATENT DOCUMENTS 5,105,067 A * 4/1992 Brekkestran ..... G05D 23/2401 2/69
8,008,606 B2 * 8/2011 Kaiserman ..... A43B 7/04 219/211

(Continued)

FOREIGN PATENT DOCUMENTS

JP 2000199109 A * 7/2000
KR 200376025 3/2005

(Continued)

*Primary Examiner* — Joseph M Pelham
(74) *Attorney, Agent, or Firm* — Cantor Colburn LLP

(57) ABSTRACT

Provided is an intelligent garment, in which a heating temperature of the garment is adjusted by sensing a size of an aperture of a garment body that is changed according to user control. The garment includes: a garment body; a heater provided in the garment body; a controller adjusting a heating temperature of the heater; and a temperature adjusting unit inputting an adjusting signal to the controller, and the adjusting signal being used for adjusting the heating temperature, wherein the temperature adjusting unit generates the adjusting signal to the controller according to a change in the size of the aperture provided in the garment body through which a body part of a user passes.

6 Claims, 7 Drawing Sheets

(51) Int. Cl.
*A41D 1/04* (2006.01)
*A41D 1/06* (2006.01)
*A41D 3/00* (2006.01)

(52) U.S. Cl.
CPC .... *A41D 2300/32* (2013.01); *A41D 2300/324* (2013.01); *A41D 2300/33* (2013.01); *H05B 2203/036* (2013.01)

(56) References Cited

U.S. PATENT DOCUMENTS

2006/0280948 A1* 12/2006 Moreshead ..... B32B 5/024 428/411.1
2008/0083721 A1* 4/2008 Kaiserman ..... A43B 3/0005 219/211
2011/0127248 A1* 6/2011 Moreshead ..... D03D 1/0076 219/209
2011/0130813 A1* 6/2011 Moreshead ..... A61F 13/00051 607/112
2012/0318781 A1* 12/2012 Lavin, Jr. ..... A41D 13/005 219/211
2013/0001212 A1* 1/2013 Mangoubi ..... H05B 1/0272 219/211
2013/0306614 A1* 11/2013 Fey, Jr. ..... A41D 1/00 219/211
2015/0173445 A1* 6/2015 Gordon ..... F25B 21/04 62/3.3
2015/0230524 A1* 8/2015 Stevens ..... A41D 13/0051 219/211
2016/0286872 A1* 10/2016 Wilson ..... A41D 13/1245
2017/0172227 A1* 6/2017 Fan ..... A41D 31/0038
2017/0209301 A1* 7/2017 DeSeve ..... A61F 7/007

FOREIGN PATENT DOCUMENTS

KR 1020070099895 10/2007
KR 101123720 3/2012
KR 20130081765 7/2013
KR 101334394 12/2013

* cited by examiner

INTELLIGENT GARMENT ADJUSTING HEATING TEMPERATURE THEREOF BY SENSING THE SIZE OF GARMENT APERTURE CHANGED ACCORDING TO USER CONTROL

BACKGROUND OF THE INVENTION

Field of the Invention

The present invention relates generally to an intelligent self-heating garment capable of adjusting temperature thereof. More particularly, the present invention relates to an intelligent self-heating garment, whereby a temperature of the garment is adjusted according to a user's intuitive action based on an experience, and the temperature is adjusted by a common action performed by a wearer when he or she feels cold without manipulation such as pressing a switch.

Description of the Related Art

Heating garments refer to garments that include a heater in the garment body and a battery, and are heated by the heater operated by power supplied from the battery.

As conventional heating garments, various garment heating techniques are disclosed in Korean Patent Nos. 10-1123720 and 10-1334394, Korean Utility Model No. 20-0376025, and Korean Patent Application Publication No. 10-2007-0099895, etc.

A heating garment is a fire hazard when the garment is heated to a high temperature. In addition, a heating temperature of the heating garment may be generally adjusted by a wearer since a proper heating temperature depends on how cold the wearer feels.

Conventionally, a switch is provided in a controller or in the garment so that the wearer presses the switch to adjust the heating temperature.

The switch is generally attached on the outside of the garment, or, inside of the garment to be concealed.

When the switch is exposed to the outside of the garment, the exterior of the garment becomes aesthetically diminished and the switch may be damaged by an external impact. Alternatively, when the switch is concealed inside the garment, a wearer may feel inconvenience when manipulating the switch with his or her hand since he or she has to open a zipper to access the switch.

In addition, a person who is visually impaired may feel inconvenience groping around the garment to find the switch.

SUMMARY OF THE INVENTION

The present invention has been keeping in mind the above problems occurring in the conventional heating garment in which a switch is essentially provided outside or inside of the garment and a wearer has to press the switch. An object of the present invention is to provide to an intelligent self-heating garment, whereby a temperature of the garment is adjusted according to a user's intuitive action based on an experience such that the exterior of the garment is not aesthetically diminished by exposing a temperature adjusting unit to the outside, there is no inconvenience when adjusting the temperature since the temperature is adjusted by a common action performed by the wearer when he or she feels cold, and a person who is visually impaired is also capable of adjusting the temperature without any inconvenience.

In order to achieve the above object, according to one aspect of the present invention, there is provided an intelligent garment, in which a heating temperature of the garment is adjusted by sensing a size of an aperture of a garment body that is changed according to user control, the garment includes: the garment body; a heater provided in the garment body; a controller adjusting a heating temperature of the heater; and a temperature adjusting unit inputting an adjusting signal to the controller, and the adjusting signal being used for adjusting the heating temperature, wherein the temperature adjusting unit generates the adjusting signal to the controller according to a change in the size of the aperture provided in the garment body through which a body part of a user passes.

The temperature adjusting unit may include: a tightening member adjusting the size of the aperture of the garment body by tightening the aperture; and a resistor provided in the tightening member and having a resistance value being changed according to an amount of tightening the aperture.

The tightening member may be a snap button or a velcro tape.

The temperature adjusting unit may be connected to the controller by forming a closed circuit through fastening male and female parts of the snap button or the velcro tape with resistors having different resistance values provided on the male or female part of the snap button or the velcro tape, whereby a fastening position of male and female parts of the snap button or the velcro tape varies according to the amount of tightening the aperture, and the resistance value of the resistor is determined by the fastening position of the male and female parts of the snap button or the velcro tape.

The tightening member may be a string fastener.

The string fastener may include a tightening string, with a variable resistance line provided in the tightening string, and connected to the controller, whereby the resistance value of the variable resistance line varies according to a strain applied to the variable resistance line.

In the intelligent self-heating garment according to the present invention with the above configuration, whereby the temperature of the garment is adjusted according to the user's intuitive action based on the experience, the exterior of the garment is not aesthetically diminished by exposing the temperature adjusting unit to the outside of the garment. In addition, the wearer does not need to manipulate the garment such as pressing a switch to adjust the temperature since the temperature of the garment is adjusted according to the wear's intuitive action based on the experience. Accordingly, the intelligent self-heating garment, whereby the temperature of the garment is adjusted according to the user's intuitive action based on the experience, and can be used by everyone such as men and women of all ages, the disabled, etc. and is a very useful invention for the development of the clothing industry.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
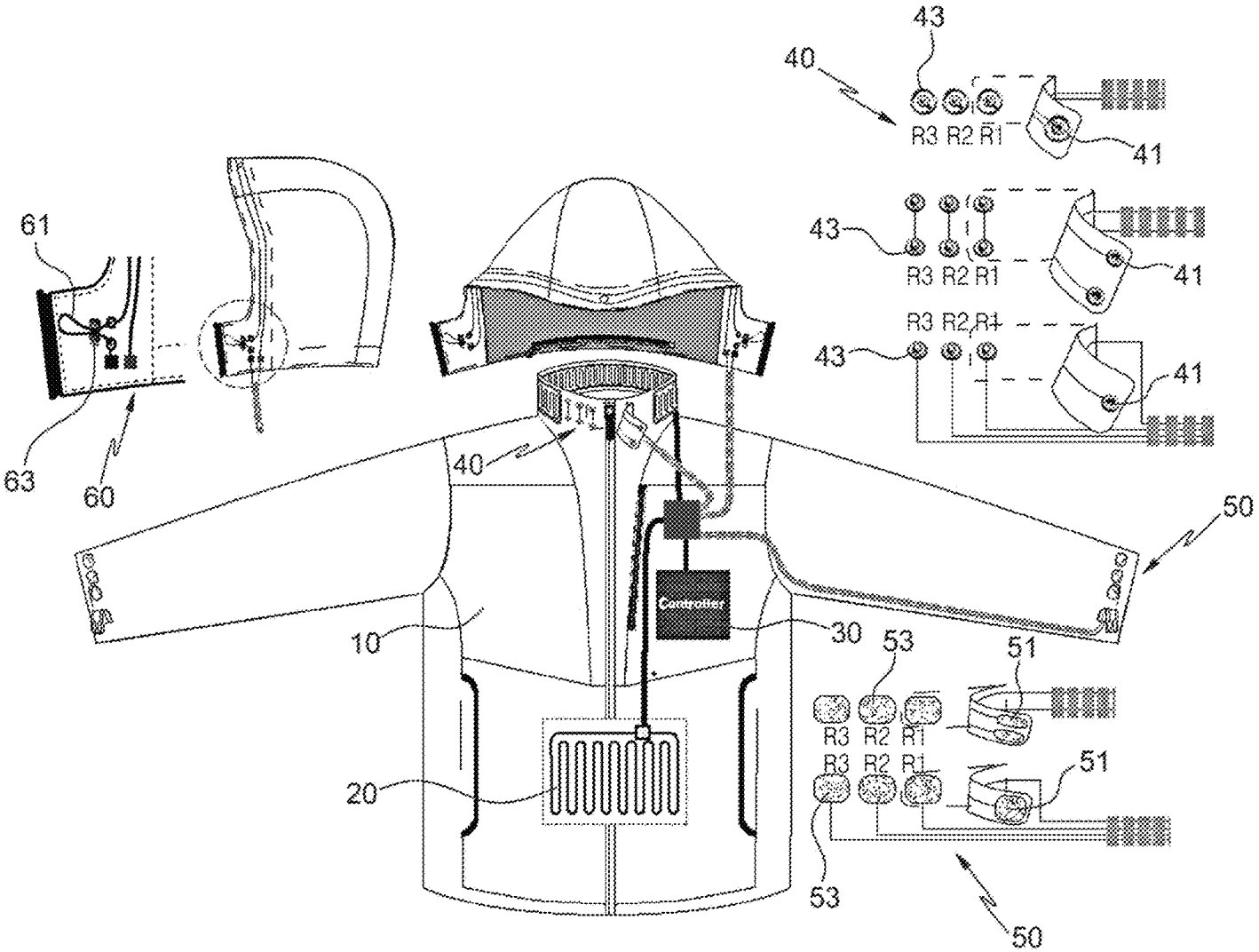
FIG. 1 is a conceptual view of an intelligent self-heating garment, whereby a temperature of the garment is adjusted according to a user's intuitive action based on an experience, according to the present invention.

Hereinafter, an intelligent self-heating garment, whereby a temperature of the garment is adjusted according to a user's intuitive action based on an experience, according to the present invention will be described in detail with reference to the attached drawings.

Before describing the present invention in detail, the present invention will now be described in detail based on aspects (or embodiments). The present invention may, however, be embodied in many different forms and should not be construed as being limited to only the embodiments set forth herein, but should be construed as covering modifications, equivalents or alternatives falling within ideas and technical scopes of the present invention.

In the figures, like reference numerals, particularly, reference numerals having the same last two digits or the same last two digits and letters refer to like elements having like functions throughout, and unless the context clearly indicates otherwise, elements referred to by reference numerals of the drawings should be understood based on this standard.

Also, for convenience of understanding of the elements, in the figures, sizes or thicknesses may be exaggerated to be large (or thick), may be expressed to be small (or thin) or may be simplified for clarity of illustration, but due to this, the protective scope of the present invention should not be interpreted narrowly.

The terminology used herein is for the purpose of describing particular aspects (or embodiments) only and is not intended to be limiting of the present invention. As used herein, the singular forms are intended to include the plural forms as well, unless the context clearly indicates otherwise. It will be further understood that the terms "comprises," "comprising,", "includes", and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present invention belongs. It will be further understood that terms used herein should be interpreted as having a meaning that is consistent with their meaning in the context of this specification and the relevant art and will not be interpreted in an idealized or overly formal sense unless expressly so defined herein.

As shown in FIG. 1, an intelligent self-heating garment whereby a temperature thereof is adjusted according to a user's intuitive action based on an experience, according to the present invention includes a garment body 10, a heater 20, a battery B, a controller 30, and a temperature adjusting unit.

The garment body 10 refers to a normal garment such as vest, suit, cardigan, jacket, shirt, pant, etc. A detailed description of the garment body 10 will be omitted since there is no limitation.

The heater 20 is provided in the garment body 10. The heater 20 may be a planar-type heater with a large area such as pad, or, may be a wire-type heater that is fine and long like a thread. It is preferable to use the wire-type heater to ensure an activity of a wearer and avoid inconvenience to the wearer while wearing.

The wire-type heater may be backstitched and attached on the garment body 10. Alternatively, a conductive yarn (functioning as the wire-type heater) may be embroidered in the garment. Alternatively, conductive yarn (functioning as the wire-type heater) may be weaved when weaving a fabric of the garment.

The heater 20 may be provided in the entire part of the garment body 10, or provided to be focused in a part having heating effect such as abdomen part, back part, a side part, etc.

The battery B provides power to the heater 20. It is preferable to use a secondary battery as the battery B such that the user is able to charge the battery B. In addition, it is preferable to use a detachable battery such that the user is able to wash the garment body 10 by detaching the battery.

The controller 30 adjusts a heating temperature of the heater 20 by controlling the power of the battery B supplied to the heater 20.

The controller 30 includes a driver 31 that controls the power of the battery B by pulse width modulation (PWM) switching and a microcomputer 33 that receives an adjusting signal of the temperature adjusting unit and adjusts the heating temperature according to the received adjusting signal. The microcomputer 33 may be connected to a temperature sensor sensing a heated temperature of the heater 20 and a display part 35 displaying a set temperature and the heated temperature of the heater 20 sensed by the temperature sensor.

The temperature adjusting unit adjusts intensity of the adjusting signal according to a change in a size of an aperture of the garment body 10 through which a body of part of the wearer passes.

In other words, when the size of the aperture is changed, the temperature adjusting unit generates the adjusting signal with different intensity to adjust the heating temperature.

The aperture provided in the garment body 10 is a part such as writs part, neck part, waist part, etc. A pocket capable of putting wear's hand in and a zipper capable of putting one's torso in may also be the aperture.

Cold air may permeate such apertures. When the wearer feels cold, the wearer may block an external cold air by tightening the aperture, putting his or her hand in the pocket, closing the zipper, and covering his or her head with a hood (hat).

The temperature adjusting unit of the present invention uses a common action of the wearer (in other words, a wear's intuitive action based on experience) that the wearer naturally performs when he or she feels cold, for a signal to adjust the heating temperature of the heating garment.

The heating temperature is adjusted by using an action performed by the wearer of the heating garment without any manipulation, and thus the wearer may not get attention from surrounding people. There is no need of manipulation to adjust the heating temperature. Accordingly, a person who is visually impaired may easily adjust the heating temperature of the heating garment without any difficulty.

The temperature adjusting unit according to the present invention operated according to the wear's intuitive action based on experience includes: a tightening member that adjusts the size of the aperture by tightening the aperture of the garment body 10; and a resistor provided in the tightening member and having a resistance value that varies according to an amount of tightening the aperture.

Herein, a snap button 40, a velcro tape 50, a string fastener 60, etc. are used as the tightening member that adjusts the size of the aperture of the garment body 10 such as wrist part and neck part The snap button 40 or the velcro tape 50 used as the tightening member is formed in a pair of parts: a female part 41, 51 and a male part 43, 53; and the female part 41, 51 and the male part 43, 53 are fastened with each other. In case of the snap button 40, the snap button 40 is formed in a pair of parts: a male button 43 in which a bump protrudes and a female button 41 in which the bump of the male button 43 is inserted. In case of the velcro tape 50, the velcro tape 50 is formed in a pair of parts: a female tape 51 having a dense pile provided on a surface thereof and a male tape 53 having tiny hooks with a rounded shape at an end thereof are provided on a surface thereof such that the dense pile and the hooks interlock when pressed together.

The female part 41, 51 and the male part 43, 53 of the snap button 40 or the velcro tape 50 are provided in the aperture of the garment body 10 to face each other. Either of the female part 41, 51 or the male part 43, 53 is provided in plural and the plurality of male or female parts is arranged in a row. When one female part 41, 51 is provided in one side of the aperture and a plurality of male parts 43, 53 is arranged in the other side of the aperture, the size of the aperture becomes smaller as the female part 41, 51 is fastened with the male parts 43, 53 that is positioned farther from the female part 41, 51.

The string fastener 60 is also used as the tightening member and includes: a tightening string 61; and a stopper 63 that holds the tightening string 61 such that the tightened state of the tightening string 61 does not become loose. A flexible tightening string may be efficiently used for the tightening string 61.

The resistor of the temperature adjusting unit provided in the snap button 40 or the velcro tape 50 is provided in either the female part 41, 51 or the male part 43, 53 that is provided in plural. Hereinafter, it is assumed that the male part 43, 53 is provided in plural.

When the male part 43, 53 is provided in plural, resistors having different resistance values are respectively provided in the male parts 43, 53. Thus, the male parts 43, 53 are distinguished from each other by the resistance value.

Herein, a resistor element, a metal pad having a unique resistance value, a conductive yarn having a unique resistance value, etc. are used as the resistor of the temperature adjusting unit. In other words, if the male parts 43, 53 have distinguishable resistance values, the male parts 43, 53 may be efficiently used as resistors. For reference, the resistors respectively provided in the male parts 43, 53 are symbolically expressed as 'R1', 'R2', and 'R3' in FIGS. 1 to 3B.

When the female part 41, 51 and the male part 43, 53 of the snap button 40 or the velcro tape 50 are fastened with each other, the temperature adjusting unit is connected to the controller 30 by forming a closed circuit. The controller 30 can confirm which of the male parts 43, 53 is fastened with the female part 41, 51 by checking the resistance value of the resistor provided in the male part 43, 53 which forms the closed circuit.

Figure 2A:
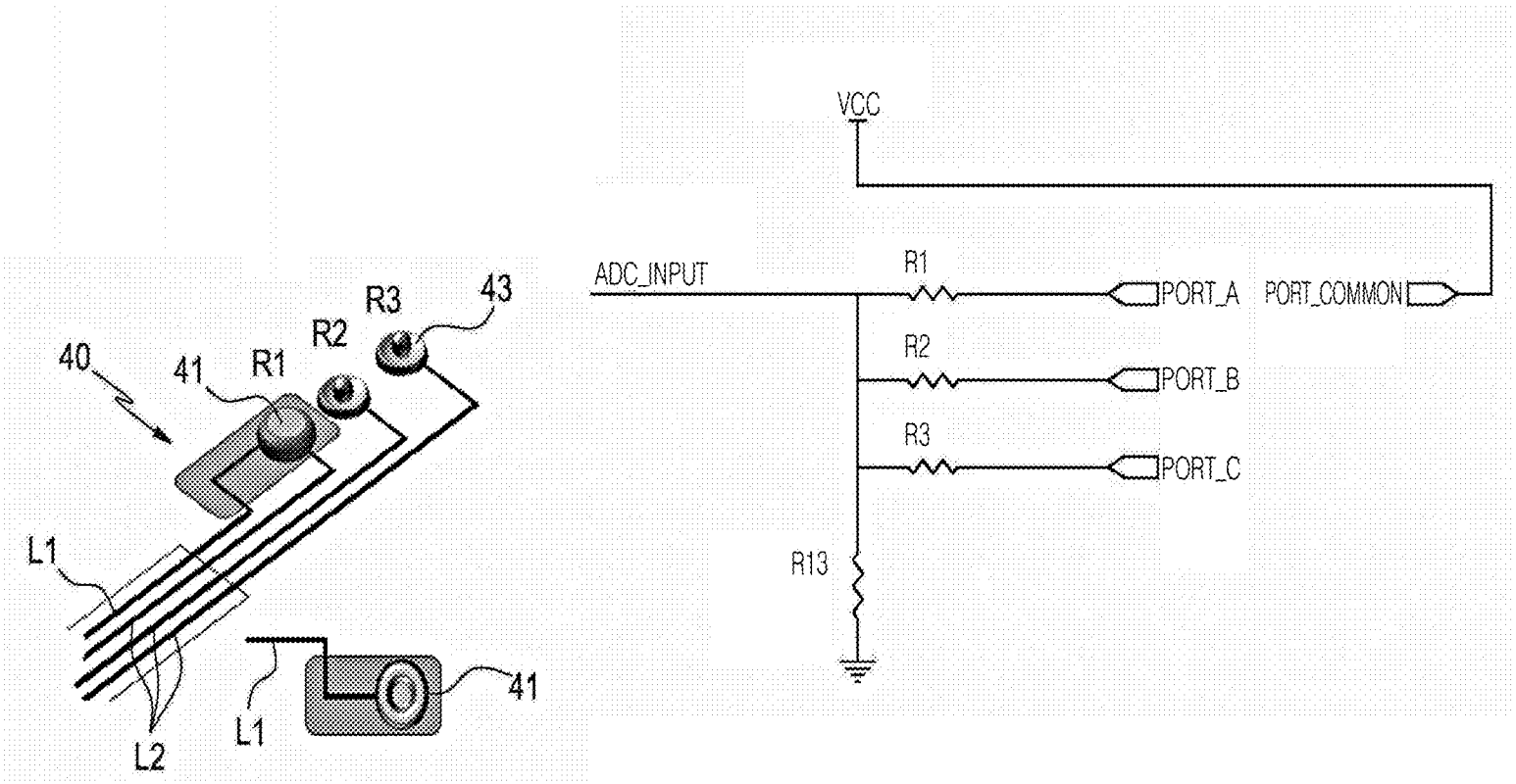
FIGS. 2A and 2B are views showing embodiments of an electrical configuration of a snap button and a velcro tape of a temperature adjusting unit.
Figure 2B:
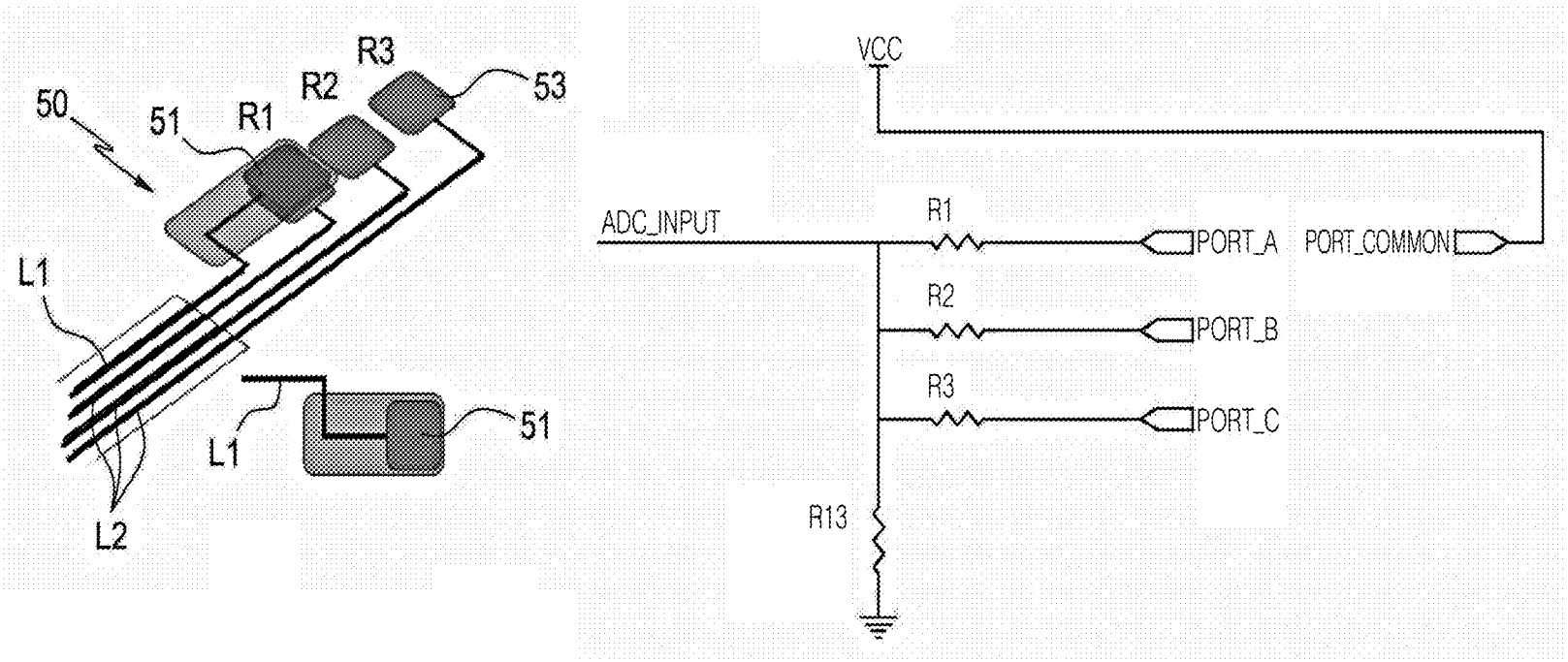

Referring to FIGS. 2A and 2B, power lines L1 and L2 are respectively connected to the female part 41, 51 and the male parts 43, 53. So, when the female part 41, 51 and one of the male parts 43, 53 are fastened with each other, the two power lines L1 and L2 are electrically connected to each other and form a closed circuit. Here, the power lines L1 and L2 are also connected to the controller 30, so when the female part 41, 51 and one of the male parts 43, 53 form a closed circuit, the controller 30 senses the male part 43, 53 that is fastened with the female part.

Figure 3A:
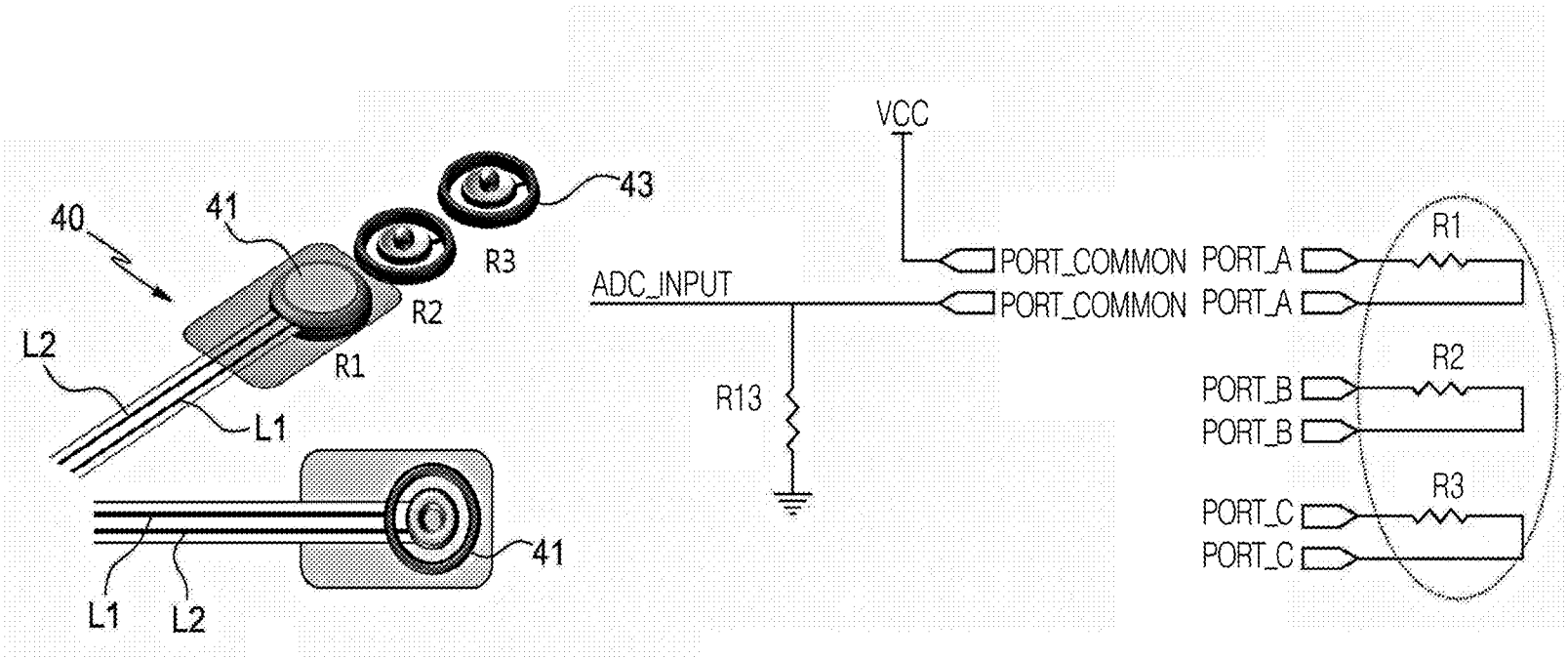
FIGS. 3A and 3B are views showing other embodiments of an electrical configuration of a snap button and a velcro tape of a temperature adjusting unit.
Figure 3B:
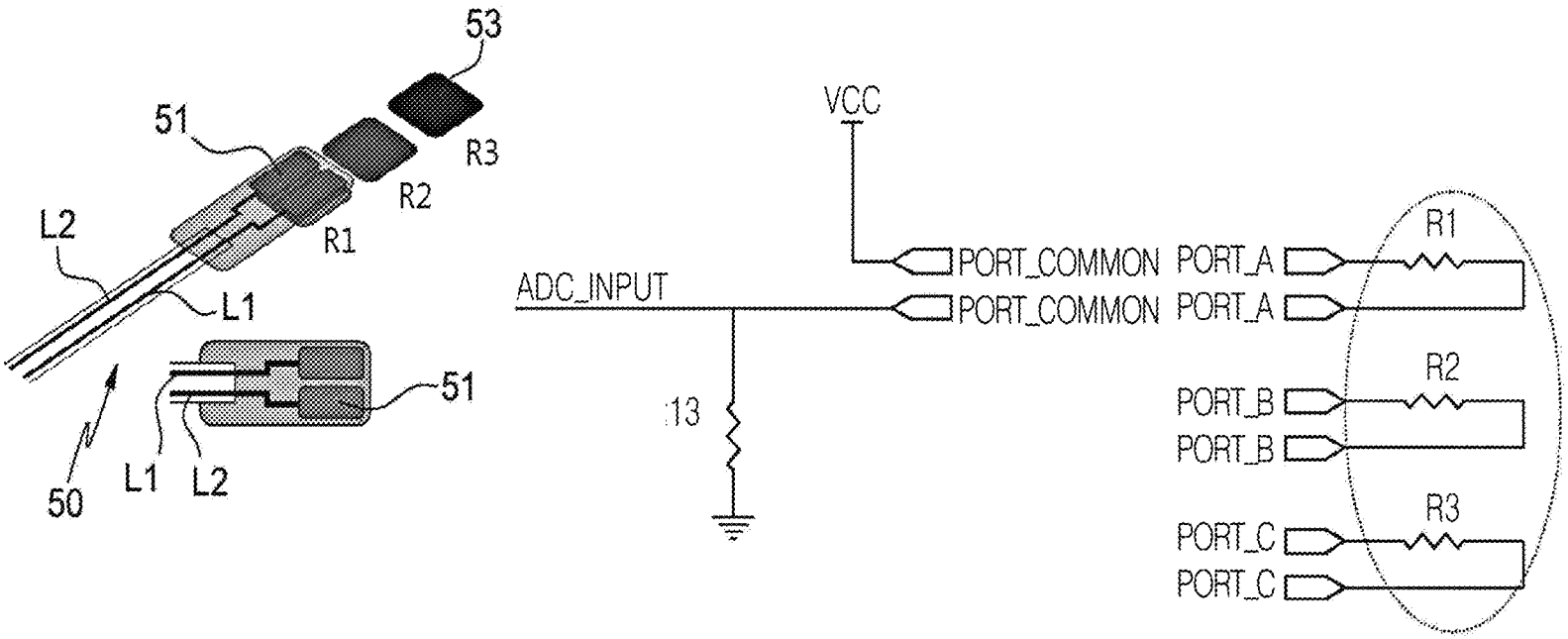

Referring to FIGS. 3A and 3B, two power lines L1 and L2 are connected to the female part 41, 51 while the two power lines L1 and L2 are disconnected from each other. Here, there is no power line connected to the mail parts 43, 53. When the female part 41, 51 is fastened with one of the male parts 43, 53, the two power lines L1 and L2 are electrically connected to each other, thereby forming a closed circuit, and the controller 30 senses the resistance value of the resistor that is provided in the male part 43, 53 fastened with the female part.

The method of FIG. 2 is relatively easier to manufacture than the method of FIGS. 3A and 3B, but the circuitry becomes complex since multiple power lines are required.

Figure 4:
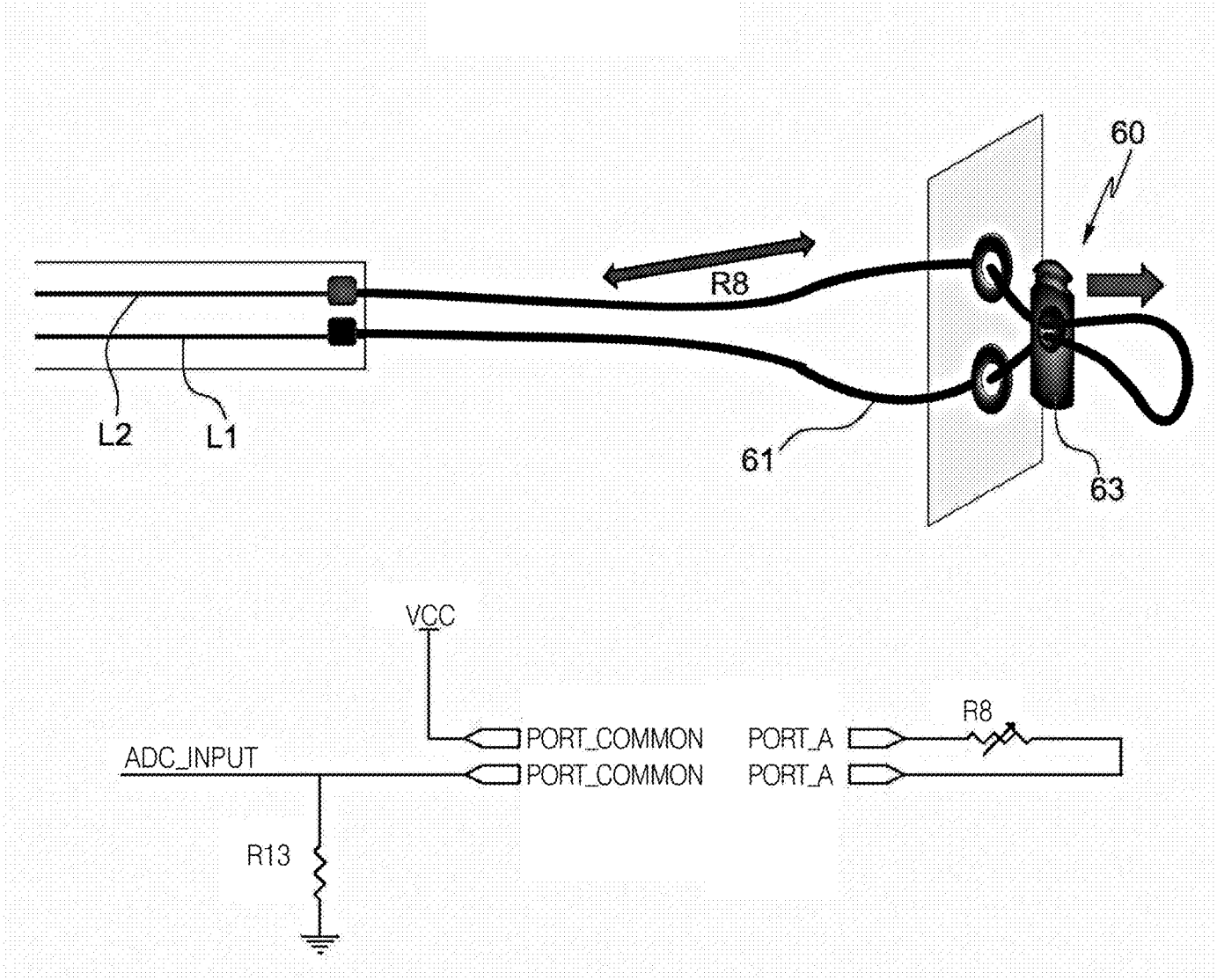
FIG. 4 is a view showing an embodiment of an electrical configuration of a string fastener of the temperature adjusting unit.
Figure 5:
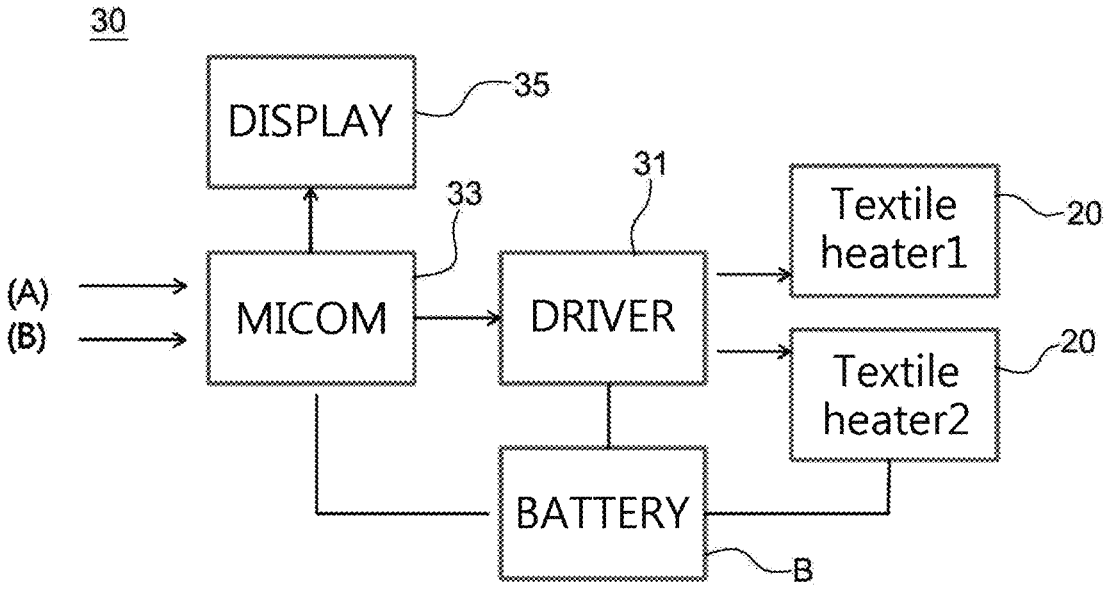
FIG. 5 is a block diagram of a controller according to the present invention.

The resistor provided in the string fastener 60 of the temperature adjusting unit is provided in the tightening string 61. For reference, the tightening string 61 of FIG. 4 is symbolically expressed as 'R8'.

Herein, a variable resistance line may be used as the tightening string 61, and thus a resistance value of the resistor provided in the tightening string 61 varies according to a stain applied to the variable resistance line. Also, opposite ends of the variable resistance line are connected to the controller 30.

When the tightening string 61 is pulled to reduce the size of the aperture of the garment body 10, the variable resistance line provided in the tightening string 61 is also pulled, and then the resistance value varies in response to the strain applied to the variable resistance line according to an amount of pulling the variable resistance line.

Herein, a resistance line having a unique resistance value may be used as the resistor of the string fastener 60.

Here, the resistance line is exposed outside the tightening string 61, so when the tightening string 61 is pulled to reduce the size of the aperture of the garment body 10 and the stopper 63 holds the pulled state of the tightening string 61, the parts of the resistance line that are placed in opposite parts of the string 61 held by the stopper 63 come into contact with each other via the stopper 63, as shown in FIG. 4. Therefore, the total resistance value of the resistance line also varies.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An intelligent garment, in which a heating temperature of the garment is adjusted by sensing a size of an aperture of a garment body that is changed according to user control, the garment comprising:

a garment body;

a heater provided in the garment body;

a controller adjusting a heating temperature of the heater; and a temperature adjusting unit inputting an adjusting signal to the controller, and the adjusting signal being used for adjusting the heating temperature, wherein the temperature adjusting unit generates the adjusting signal with different intensity according to a change in a size of an aperture provided in the garment body through which a body part of a user passes, and inputs the adjusting signal to the controller.

2. The garment of claim 1, wherein the temperature adjusting unit includes:

a tightening member adjusting the size of the aperture of the garment body by tightening the aperture; and a resistor provided in the tightening member and having a resistance value being changed according to an amount of tightening the aperture.

3. The garment of claim 2, wherein the tightening member is a snap button or a velcro tape.

4. The garment of claim 3, wherein the temperature adjusting unit is connected to the controller by forming a closed circuit through fastening male and female parts of the snap button or the velcro tape, with resistors having different resistance values provided on the male or female part of the snap button or the velcro tape, whereby a fastening position of the male and female parts of the snap button or the velcro tape varies according to the amount of tightening the aperture, and the resistance value of the resistor is determined by the fastening position of the male and female parts of the snap button or the velcro tape.

5. The garment of claim 2, wherein the tightening member is a string fastener.

6. The garment of claim 5, wherein the string fastener includes a tightening string, with a variable resistance line provided in the tightening string and connected to the controller, whereby the resistance value of the variable resistance line varies according to a strain applied to the variable resistance line.

* * * * *